US006877965B2

(12) United States Patent
McCall et al.

(10) Patent No.: US 6,877,965 B2
(45) Date of Patent: Apr. 12, 2005

(54) MECHANICAL BLADDER PUMP

(75) Inventors: Wesley McCall, Salina, KS (US); Thomas M. Christy, Salina, KS (US); David Cooper, Salina, KS (US)

(73) Assignee: Kejr, Inc., Salina, KS (US)

( * ) Notice: Subject to any disclaimer, the term of this patent is extended or adjusted under 35 U.S.C. 154(b) by 0 days.

(21) Appl. No.: 10/632,294

(22) Filed: Jul. 31, 2003

(65) Prior Publication Data

US 2004/0091378 A1 May 13, 2004

Related U.S. Application Data

(60) Provisional application No. 60/400,364, filed on Jul. 31, 2002.

(51) Int. Cl.[7] ..... F04B 43/00; F04B 39/10

(52) U.S. Cl. ..... 417/472; 417/478; 417/555.2; 166/264

(58) Field of Search ..... 417/394, 471, 417/472, 478, 554, 555.1, 555.2; 166/105, 108, 109, 110, 264; 175/59, 60; 137/147, 151, 515, 515.3, 515.5, 515.7

(56) References Cited

U.S. PATENT DOCUMENTS

| | | | | | |
|---|---|---|---|---|---|
| 2,613,610 | A | * | 10/1952 | Royal | 417/313 |
| 2,822,121 | A | * | 2/1958 | Sadler et al. | 137/209 |
| 4,015,913 | A | * | 4/1977 | Nakamura | 417/471 |
| 4,483,665 | A | * | 11/1984 | Hauser | 417/401 |
| 4,749,337 | A | * | 6/1988 | Dickinson et al. | 417/199.1 |
| 5,022,312 | A | * | 6/1991 | Rozek et al. | 92/240 |
| 5,207,339 | A | * | 5/1993 | Shyu | 215/228 |
| 5,336,061 | A | | 8/1994 | Armstrong | 417/411 |
| 5,411,381 | A | * | 5/1995 | Perrodin | 417/472 |
| 5,915,930 | A | * | 6/1999 | McNaull | 417/417 |
| 6,089,141 | A | * | 7/2000 | Okesaku | 92/129 |

OTHER PUBLICATIONS

"Armstrong Solar Powered Water Pumping System Offers Low–tech Simplicity," *Resource Engineering & Technology for a Sustainable World*, vol. 10, No. 6, p. 8 (Jun. 2003).

Puls, Robert W. et al., "Low–Flow (Minimal Drawdown) Ground–Water Sampling Procedures," *EPA Ground Water Issue*, Apr. 1996.

Product Brochure for "Pneumatic Bladder Pump," Geoprobe Systems, Salina, Kansas.

* cited by examiner

*Primary Examiner*—Charles G. Freay
(74) *Attorney, Agent, or Firm*—Jeffrey L. Thompson; Thompson & Thompson, P.A.

(57) ABSTRACT

A mechanical bladder pump is provided for collecting fluid samples from a well. The pump includes an outer tubular member having a longitudinal bore, and an inner tubular member arranged within the bore of the outer tubular member. The inner and outer tubular members are connected at their lower ends to a compressible bladder, and are arranged for oscillating movement relative to each other to expand and compress the bladder. The lower end of the bladder is open to an inlet passage, and the upper end of the bladder is open to an outlet passage. First and second check valves are provided to control the flow of fluid through the bladder during operation of the pump. A return spring is used to store energy during a tension stroke of the inner tubular member and to release energy during a compression stroke thereof. The pump provides highly representative samples of groundwater.

16 Claims, 4 Drawing Sheets

(a)
UPSTROKE
BLADDER
EXTENDING (b)
DOWNSTROKE
BLADDER
COMPRESSING

MECHANICAL BLADDER PUMP

RELATED APPLICATIONS

This application claims priority of U.S. Provisional Application No. 60/400,364 filed on Jul. 31, 2002.

BACKGROUND OF THE INVENTION

1. Field of the Invention

The present invention relates generally to devices for pumping fluids from one location to another. In particular, the present invention relates to devices and methods for obtaining groundwater samples from monitoring wells.

2. Description of the Related Art

Collection of representative groundwater samples from monitoring wells or other sampling devices has been the topic of much debate and research in the environmental field for more than twenty years. Not until the mid-1990s did the U.S. Environmental Protection Agency ("EPA") establish a widely accepted methodology for obtaining representative groundwater samples. This accepted methodology is called the "low-flow minimal-draw down" procedure for sampling groundwater (EPA 1996). This sampling methodology was designed to have minimal impact on the water quality and chemistry of the sample collected, especially with respect to volatile organic contaminants (VOC) such as trichloroethene or benzene. Water quality and chemistry is easily altered by elevated temperatures, excessive agitation, or use of vacuum (negative pressure) to collect the samples.

Gas driven bladder pumps are commonly used for collecting groundwater samples for environmental investigations. Such pumps have a minimal effect on temperature, cause little agitation of the sample, and induce minimal negative pressure on the sampled medium.

While gas driven bladder pumps are commonly used for collecting representative groundwater samples, there are some limitations to existing systems. Two of these limitations are the amount of equipment required to conduct sample collection and the cost. To operate the gas drive bladder pump, the following equipment is typically required:

| Item | Estimated Cost Range |
|---|---|
| 1) bladder pump | $500 to $1200 |
| 2) pump controller | $1200 to $1800 |
| 3) source of gas | |
| Oiless Air Compressor | $250 to $700 |
| Compressed Gas Cylinders | $10 to $20 per sample event |
| 4) Power Supply to Operate Compressor | |
| Portable Generator (purchase) | $300 to $700 |
| (rental) | $50 to $100 per day |

When sampling is conducted with the gas driven bladder pump system, a truck or van is required to contain and transport all of this equipment. One or two men may be tasked with the sampling operation. The collection of samples with this system is expensive, especially if the bladder pumps are dedicated to the wells as recommended by regulatory guidelines. There are often 5 to 10 wells at the site requiring dedicated pumps. There are literally thousands of sites around the country that require ground water monitoring on an annual basis, and many of these must be sampled every three months to meet regulatory requirements.

Because of the regulatory requirements to obtain representative groundwater samples, there is a significant need for improved methods and equipment to accomplish these goals. Gas driven bladder pumps have been the preferred equipment for collection of representative groundwater samples. Although the gas driven bladder pump provides high quality samples, it is expensive to purchase and operate, as outlined above.

Thus, there is a need in the industry for an improved device to collect representative groundwater samples at a lower cost.

SUMMARY OF THE INVENTION

An object of the present invention is to provide an improved fluid pumping device and method that overcome the problems and shortcomings of the prior art.

A further object of the present invention is to provide an improved mechanical bladder pump and method for collecting fluid samples from monitoring wells, which can be used effectively to collect fluid samples with minimal disturbance of the sample so that water quality is not altered, turbidity is low, and loss of volatile contaminants is negligible.

A further object of the present invention is to provide a bladder pump that does not require a pump controller, air compressor, power supply to run the compressor, special connections, and pressure hoses to connect and operate the pump for low-flow ground water sampling.

A further object of the present invention is to provide a bladder pump that can be operated with a relatively small power supply, that is highly portable and mobile; is inexpensive to manufacture, maintain and operate; is capable of a long operating life; and that will meet or exceed the flow rate requirements for environmental sampling using low-flow, minimal draw down methods.

In order to accomplish these and other objects of the invention, a mechanical bladder pump is provided for collecting fluid samples from a well. The pump comprises: an outer tubular member having a longitudinal bore; an inner tubular member arranged within the bore of the outer tubular member for oscillating longitudinal movement of the inner member relative to the outer member; and a bladder having a first end coupled to a lower end of the inner member and a second end coupled to a lower end of the outer member. One of the first and second ends of the bladder is in fluid communication with an inlet passage, and the other of the first and second ends of the bladder is in fluid communication with an outlet passage.

A first check valve is arranged in the inlet passage for allowing fluid to enter the bladder through the inlet passage upon expansion of the bladder and preventing fluid from exiting the bladder through the inlet passage upon compression of the bladder. A second check valve is arranged in the outlet passage for preventing fluid from entering the bladder through the outlet passage upon expansion of the bladder and allowing fluid to exit the bladder through the outlet passage upon compression of the bladder. A return spring is also provided that stores energy during a tension stroke of the inner member and releases energy during a compression stroke of the inner member.

According to another broad aspect of the present invention, a fluid pumping device is provided, comprising: an inner member and an outer member which are arranged together for oscillating movement relative to each other; and a pump mechanism operated by the oscillating movement of the inner and outer members. The pump mechanism comprises a bladder having a first end attached to the inner member and a second end attached to the outer member.

According to another broad aspect of the present invention, a fluid pumping device is provided, comprising: an inner member and an outer member which are arranged together for oscillating movement relative to each other; a pump mechanism operated by the oscillating movement of the inner and outer members; and a return spring that stores energy during a tension stroke of the inner member and releases energy during a compression stroke of the inner member.

Numerous other objects of the present invention will be apparent to those skilled in this art from the following description wherein there is shown and described a preferred embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE PREFERRED EMBODIMENT

Figure 1:
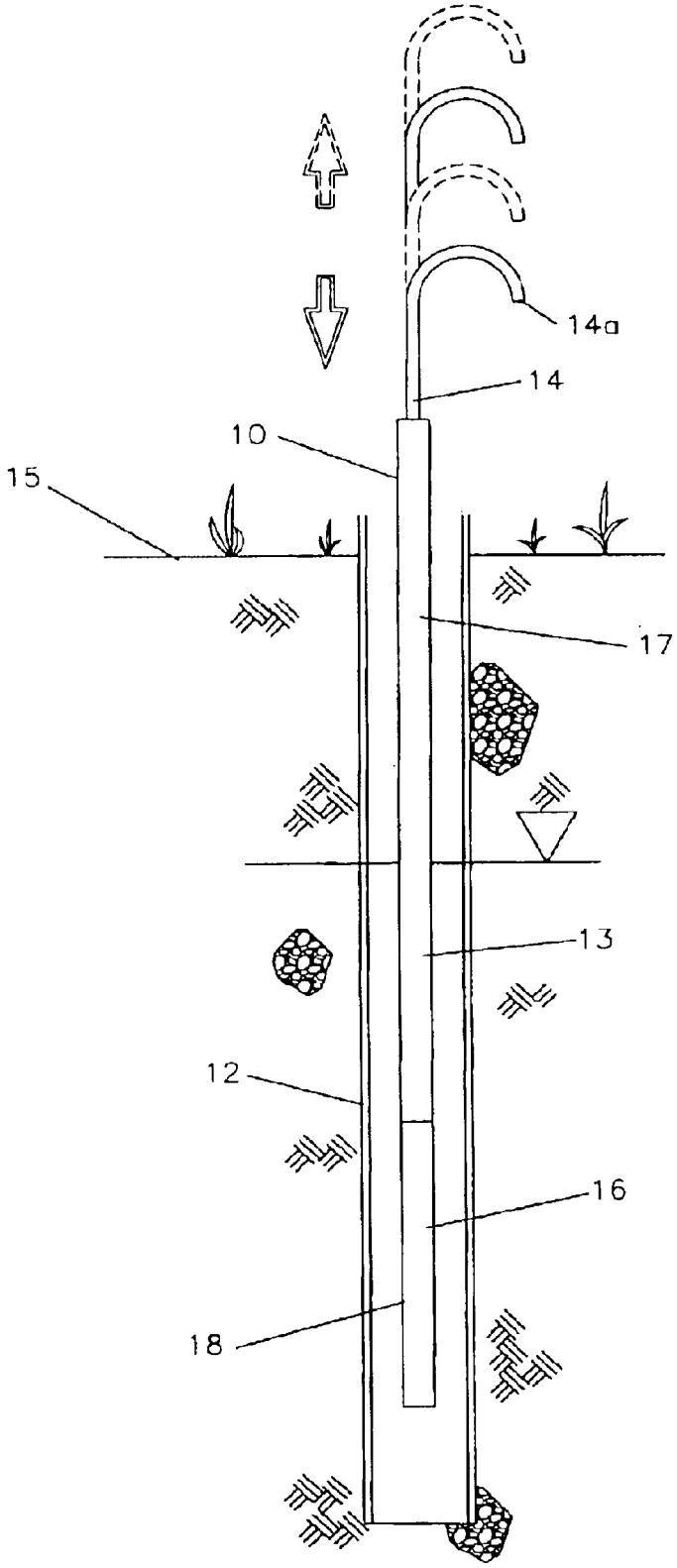
FIG. 1 is an elevation view of a mechanical bladder pump device according to the present invention positioned within a well of a monitoring site.
Figure 2:
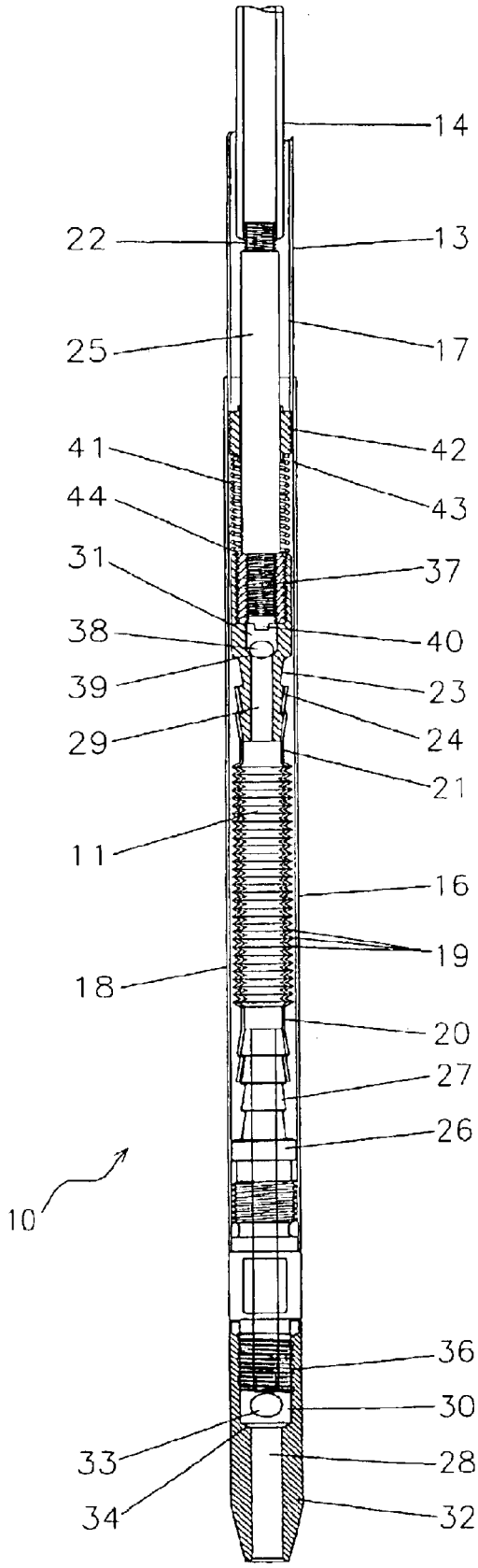
FIG. 2 is a cross section elevation view of the mechanical bladder pump device according to the present invention.
Figure 3:
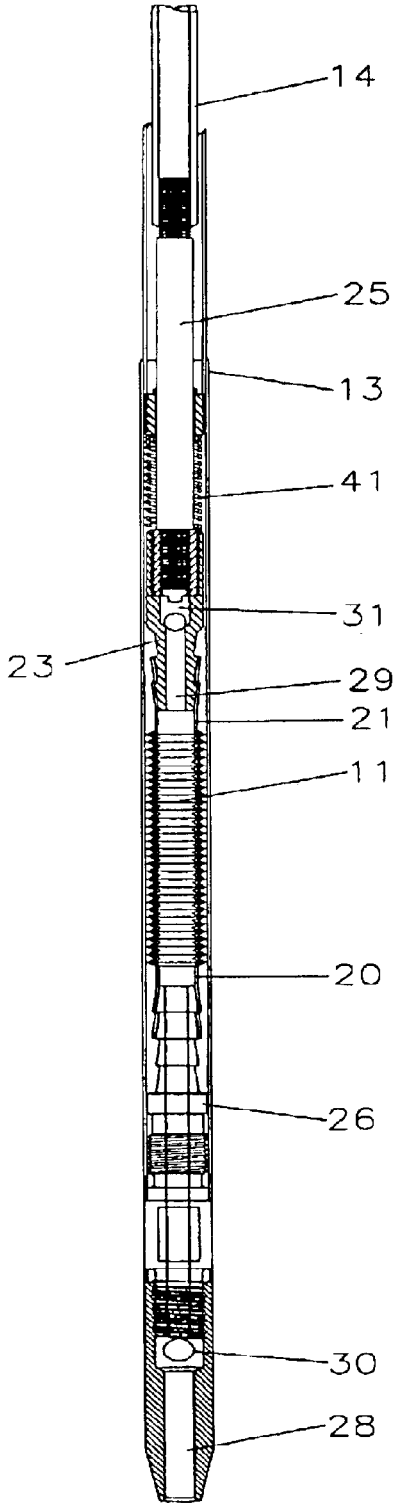
FIG. 3 is a cross section elevation view of the mechanical bladder pump device with the bladder in its extended position and the inner tube near the upper end of an upstroke.
Figure 4:
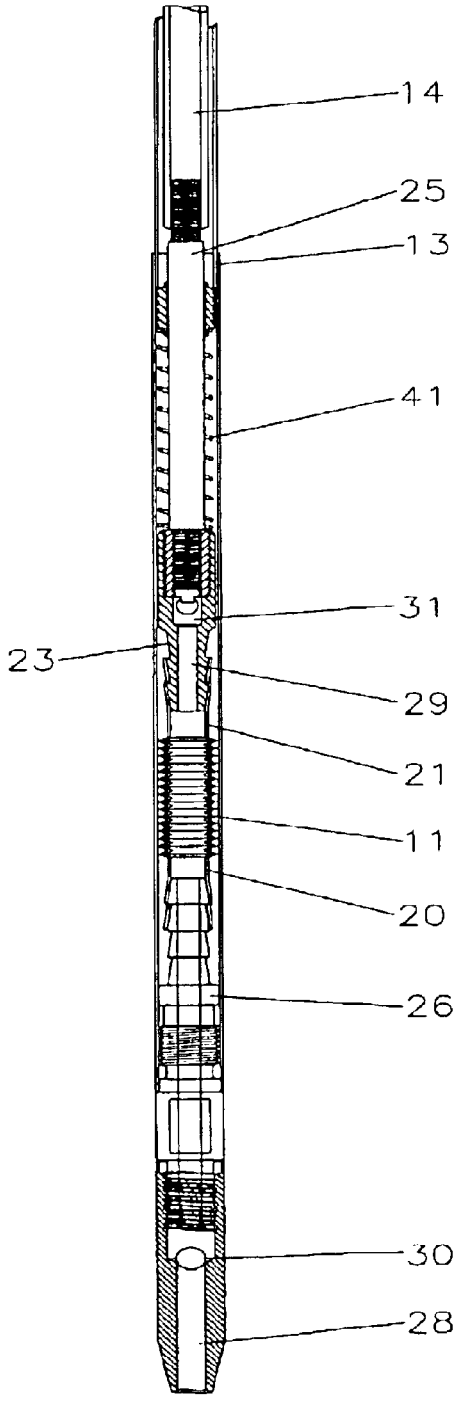
FIG. 4 is a cross section elevation view of the mechanical bladder pump device with the bladder in its compressed position and the inner tube near the lower end of a downstroke.

A mechanical bladder pump device 10 according to a preferred embodiment of the present invention will now be described with reference to FIGS. 1 to 5 of the accompanying drawings.

The mechanical bladder pump 10 of the present invention is a pumping device that uses a compressible bladder 11 to pump water or other fluids from one location to another by alternating between compression and expansion of the bladder 11. Fluid flow rate from the pump 10 can be controlled by the rate and amount of compression and expansion of the bladder 11. The bladder pump 10 is particularly suitable for collecting ground water samples from monitoring wells 12 and the like. When operated properly, the pump 10 can provide representative samples of groundwater with minimal, if any, disturbance of the water chemistry or quality.

The pump 10 includes an outer tubular member 13 having a longitudinal bore, and an inner tubular member 14 arranged concentrically within the bore of the outer tubular member 13. The inner and outer tubular members 13, 14 are preferably long cylindrical parts made of metal, plastic, polymer, or other suitably rigid material with threads or other suitable means for attaching parts at either end. The inner and outer tubular members 13, 14 are arranged together for oscillating movement of the inner member 14 relative to the outer member 13 when placed in a well 12. The inner tubular member 14 provides a means for transmitting force for mechanically powering the pump 10 from above the ground surface 15 or other point of operation of the pump 10. The outer tubular member 13 is preferably provided in two parts with a lower part comprising a pump body 16 and an upper part comprising a cylindrical tube 17 for holding the pump body 16 in a desired position within the well 12.

A pump mechanism 18 is provided within the outer tubular member 13 near a lower end thereof. The pump mechanism 18 includes the bladder 11, which is formed of a plastic, polymer, rubber or similar material having corrugations 19 along its length and smooth cuffs 20, 21 at either end to facilitate attachment. The corrugations 19 can be a series of concentric folds with ridges and grooves spaced along the length of the bladder, or they can be ridges and grooves formed in the shape of a cylindrical or conical helix, or other suitable structure that allows the bladder to expand and contract within the confined space defined by the outer tubular member 13. The bladder 11 is open on each of its ends and can be expanded and contracted in a longitudinal direction. Other types of bladders can also be used in the present invention, such as a flexible rubber sac or other balloon-type member disposed within the space defined by the outer tubular member 13.

The use of a bladder in the present invention is important because it buffers or moderates vacuum and pressure changes during operation of the pump. The bladder also minimizes turbulence that might alter the quality of the water sample, and minimizes contact with inner moving parts of the pump that might contaminate the water sample. The water sample only contacts the check valves and the inner tubing and does not contact piston seals and the like as in conventional nonbladder-type pumps. The bladder thereby minimizes disturbance in the water chemistry or quality and allows representative samples of groundwater to be collected.

The upper end 21 of the bladder is fixed relative to a lower end 22 of the inner tubular member 14 by an assembly including an upper bladder adapter 23 and an inner tube connector 25. The upper bladder adapter 23 has a barbed fitting 24 or other structure allowing attachment to the cuff 21 at the upper end of the bladder 11. The inner tube connector 25 can be used to couple the upper bladder adapter 23 to the inner tubular member 14. The inner tube connector 25 is preferably equipped with threads or other suitable means at each end to attach to the respective ends of the upper bladder adapter 23 and the inner tubular member 14.

The lower end 20 of the bladder 11 is coupled to a lower end of the outer tubular member 13 by a lower bladder adapter 26. The lower bladder adapter 26 has a barbed fitting 27 or other structure allowing attachment to the cuff 20 at the lower end of the bladder 11.

The bladder 11 is compressed upon relative movement between the inner and outer tubular members 13, 14 in a first direction in which the inner tubular member 14 is moved downward within the bore of the outer tubular member 13. The bladder 11 is expanded upon relative movement between the inner and outer tubular members 13, 14 in a second direction in which the inner tubular member 14 is moved upward within the bore of the outer tubular member 13.

The lower end 20 of the bladder 11 is in fluid communication with an inlet passage 28, and the upper end 21 of the bladder 11 is in fluid communication with an outlet passage 29. The upper bladder adapter 23 functions as a movable piston or actuator to compress and expand the bladder 11 during operation of the pump 10. The oscillating relative movement of the inner and outer tubular members 13, 14 is used to compress and expand the bladder 11 for pumping.

First and second check valves 30, 31 are disposed in the inlet and outlet passages 28, 29, respectively. The check valves 30, 31 are arranged to allow fluid to enter the lower end 20 of the bladder 11 upon expansion of the bladder 11, and to cause fluid to exit the upper end 21 of the bladder 11 upon compression of the bladder 11.

The first check valve 30 is arranged in the inlet passage 28 for allowing fluid to enter the bladder 11 through the inlet passage 28 upon expansion of the bladder 11, and preventing fluid from exiting the bladder 11 through the inlet passage 28 upon compression of the bladder 11. The first check valve 30 includes an inlet check ball housing 32 coupled to the lower bladder adapter 26. A first check ball 33 is positioned within a space between a valve seat 34 defined on the inlet check ball housing 32 and a projection 35 on a lower end 36 of the lower bladder adapter 26. The first check ball 33 is movable between a closed position in which it is seated on the valve seat 34, and an open position in which it floats above the valve seat 34 and may engage the projection 35. The projection 35 on the lower bladder adapter 26 prevents the first check ball 33 of the first check valve 30 from seating against the lower bladder adapter 26 and closing the inlet passage 28 upon expansion of the bladder 11. The projection 35 can be, for example, a tang or tab structure that projects from the lower end of the lower bladder adapter 26, or the portion of the lower bladder adapter 26 that remains after one or more slots are milled in the lower end of the adapter 26.

The second check valve 31 is arranged in the outlet passage 29 for preventing fluid from returning to the bladder 11 through the outlet passage 29 upon expansion of the bladder 11, and allowing fluid to exit the bladder 11 through the outlet passage 29 upon compression of the bladder 11. The second check valve 31 includes a check ball retainer 37 attached between an upper end of the upper bladder adapter 23 and a lower end of the inner tube connector 25. A second check ball 38 is positioned within a space between a valve seat 39 on the upper bladder adapter 23 and at least one projection 40 on a lower end of the check ball retainer 37. The second check ball 38 is movable between a closed position in which it is seated on the valve seat 39, and an open position in which it floats above the valve seat 39 and may engage the projection 40. The projection 40 on the lower end of the check ball retainer 37 prevents the second check ball 38 from closing off the second passage 29 upon compression of the bladder 11. The projection 40 can be, for example, a tang or tab structure that projects from the lower end of the check ball retainer 37, or the portion of the retainer 37 that remains after one or more slots are milled in the lower end of the retainer 37.

A return spring 41 is arranged within the pump 10 to bias the inner tubular member 14 downwardly relative to the outer tubular member 13. The return spring 41 is preferably an expansion spring made of metal or other suitable material that will assist with compression of the bladder 11 during operation of the pump 10. Additional return springs can be used as necessary to provide the desired spring rate or stroke length.

When the inner tubular member 14 is moved upward in its tension stroke, the return spring is 41 compressed, therefore storing energy. When tension on the inner tubular member 14 is released, the return spring 41 releases its stored energy and expands in length. Expansion of the return spring 41 forces the upper end of the bladder 11 downward and compresses the bladder 11 while simultaneously pulling the inner tubular member 14 downward in its compression stroke. Thus, the return spring 41 substantially reduces or eliminates the amount of downward force (i.e., compression) that must be imparted to the upper end of the inner tubular member 14 during operation of the pump mechanism.

The return spring 41 provides an important feature of the invention because it allows the pump 10 to achieve higher flow rates and to be used at greater operating depths, particularly when a flexible inner tubular member 14 is used (e.g., a member such as polymeric tubing, wire or cable, which is capable of transmitting substantially more force in tension than compression). In the preferred embodiment, at least a portion of the inner tubular member 14 is made of polymeric tubing.

A spring retainer 42 is secured within the bore of the outer tubular member 13 to hold the return spring 41 in position during operation of the pump 10. The spring retainer 42 provides an upper vertical stop against which an upper end of the spring 41 rests. The spring retainer 42 can be provided with a circular lip 43 on a lower end thereof to help retain the spring 41 in a concentric position relative to the inner tubular member 14 to prevent misalignment of the spring 41 and faulty operation of the pump 10. In an alternative embodiment, the outer tubular member 13 can be rolled or crimped to form a reduced diameter portion on an inner wall thereof that provides generally the same function as the spring retainer 42. A surface on an upper end of the upper bladder adapter 23 provides a seat 44 for a lower end of the spring 41.

Figure 5:
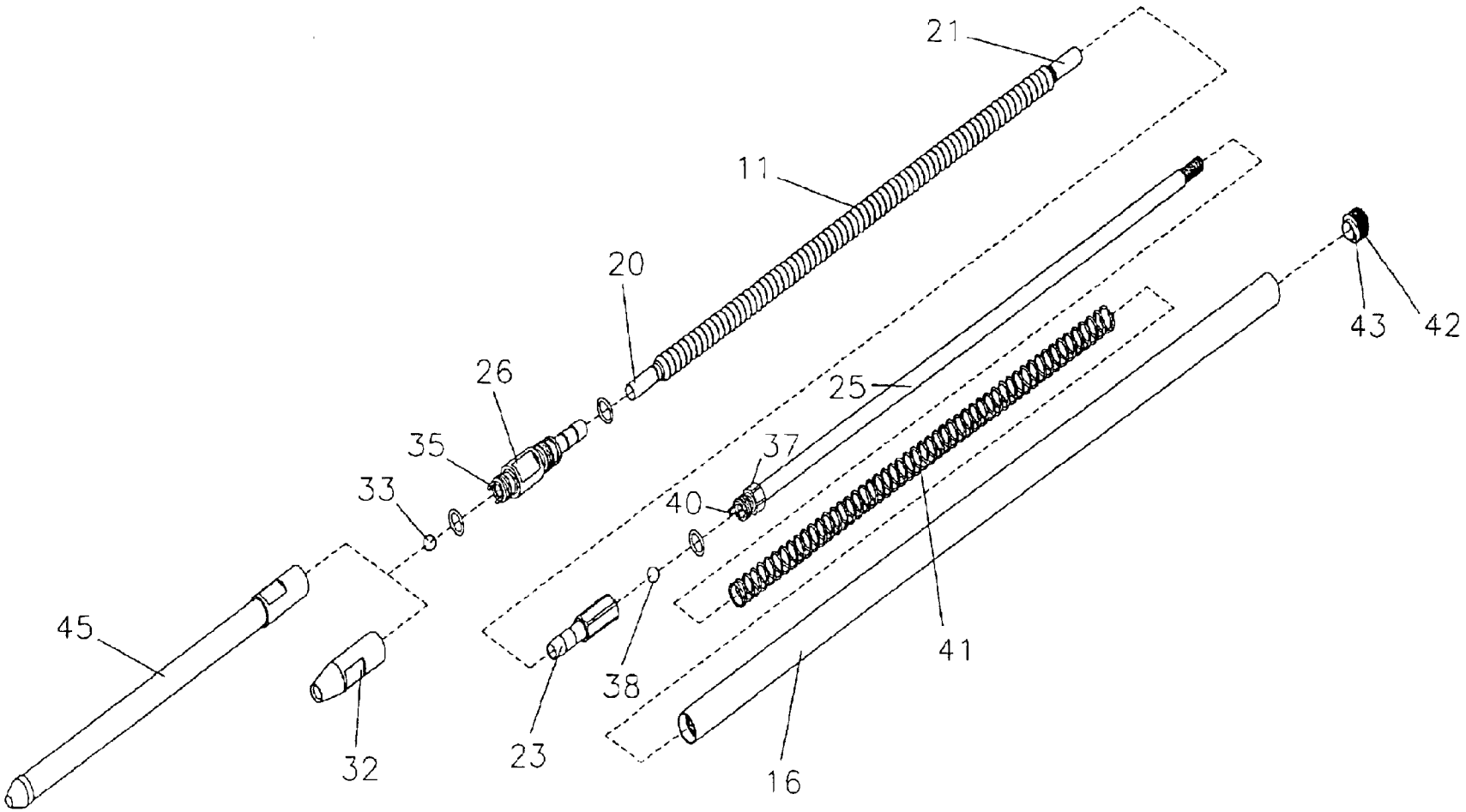
FIG. 5 is an exploded perspective view of the mechanical bladder pump device according to the present invention.

An intake filter 45 can be provided to prevent potentially damaging particulates from entering the pump 10. The intake filter 45 can be a metal screen having a cylindrical shape as shown in FIG. 5, or can be formed in a different shape or with another material which is porous to the fluid being sampled. The intake filter 45 can be attached to the lower end of the pump 10 over the inlet passage 28.

The construction of a preferred embodiment of the mechanical bladder pump of the present invention has been described above. The operation of the pump will now be described.

The mechanical bladder pump 10 is partially assembled so that the inner tube connector 25 extends above the pump body 16. The inner tubular member 14 and the cylindrical tube portion 17 of the outer tubular member 13 are prepared having a sufficient length to insert the pump 10 to the desired depth. The inner tubular member 14 should be longer than the cylindrical tube portion 17 of the outer tubular member 13. The inner and outer tubular members 14, 13 are sized to provide sufficient annular space between the two tubes to minimize friction. One or both of the tubular members 13, 14 can be formed of a friction reducing material, such as TEFLON® FEP or KYNAR®. The inner tubular member 14 is attached to the inner tube connector 25, and the cylindrical tube portion 17 of the outer tubular member 13 is threaded or otherwise attached or inserted into the upper end of the pump body 16. The pump and tubing are then lowered to the desired depth inside the well 12 or other fluid reservoir. While the outer tubular member 13 is held rigidly in position at the ground surface 15, the inner tubular member 14 is oscillated up and down to operate the pump 10.

As the inner tubular member 14 is pulled up or outward from the outer tubular member 13, the bladder 11 is expanded and fluid is drawn in through the pump inlet passage 28 and flows into the bladder 11. The return spring 41 is compressed to store energy during this tension stroke of the inner member 14. Also, during this tension stroke, the upper check ball 38 is seated and the lower check ball 33 is open to permit influx of the fluid.

Next, the inner tubular member 14 is pushed down or into the outer tubular member 13 from the ground surface 15. As the inner tubular member 14 is pushed in during this compression stroke, the return spring 41 releases its energy by expanding, thereby helping to both pull the inner tubular member 14 downward and compress the pump bladder 11. As compression of the bladder 11 begins, the lower check valve 30 is closed to prevent fluid from escaping from the pump 10, and the upper check valve 31 is opened. As the bladder 11 is compressed during the compression stroke, fluid flows up the inner tubular member 14. Repeatedly pulling the inner tubular member 14 out and pushing it in (oscillating up and down) relative to the outer tubular member 13 causes fluid to be pumped to the surface and out the outlet 14*a* of the inner tubular member 14 for collection as a sample or other desired use.

In the preferred embodiment described above, the pump 10 is operated by up and down movement of the inner tubular member 14 relative to the outer tubular member 13. It would also be possible to hold the inner tubular member 14 rigidly in place and oscillate the outer tubular member 13 up and down to operate the pump 10. However, for environmental sampling of groundwater, oscillation of the outer tubular member would agitate the groundwater being sampled. This could degrade sample quality, thereby possibly causing loss of volatile constituents and increased suspended particulates (turbidity).

In a modified embodiment, pumping action can be accomplished by replacing the inner tubular member 14 with a solid central rod, wire, or flexible cable (not shown) and directing the flow of liquid to the annular space between this central rod, wire, or flexible cable and the outer tubing.

In another embodiment, pumping action can be accomplished by removing the bladder 11 from the device and replacing the upper bladder adapter 23 with a piston (not shown) containing a fluid passage and a check valve. The inner tubular member 14 would then be used to oscillate this piston up and down, alternately drawing water in through the lower check valve 30 during the up stroke, and discharging water through the check valve in the moveable piston during the down stroke. Using a piston to replace the bladder may be the preferred method of construction of the pump under some conditions. These conditions may include, but are not limited to, situations when the liquids being pumped are incompatible with the material of the bladder. For general purposes of sampling groundwater, the bladder is the preferred embodiment because it simplifies the device, allows for minimal negative pressure on the fluid being sampled, and assures a sealed system for groundwater sampling.

In another embodiment, springs or magnets can be used to keep the check balls of the first and second check valves 30, 31 seated without the need for vertical orientation in a gravitational field. This embodiment could allow for use of the pump in horizontal and other applications.

In another embodiment, a mechanical or electrical device can be used to power the up and down oscillatory movement of the inner tubular member 14 required to expand and compress the bladder 11. This will allow a controlled and predictable pumping rate to be achieved.

Although the return spring 41 in the preferred embodiment is an expansion spring having metal coils, it is contemplated that other types of springs may also be used in the present invention. For example, gas drive springs or compressed air springs may also be used. Alternatively, a spring can be formed into the sidewall of the bladder to function as the return spring.

In another embodiment, a tension spring (not shown) can be positioned inside or built into the bladder 11 between the upper bladder adapter 23 and the lower bladder adapter 26. Such a tension spring within the bladder 11 would have an upper end connected to an upper end of the bladder or to the upper bladder adapter 23 and a lower end connected to the lower end of the bladder or the lower bladder adapter. The tension spring within the bladder would be a substitute for the return spring 41 described above and would function to assist with compressing the bladder 11 during operation of the pump 10.

The following provides a summary of the primary advantages of the mechanical bladder pump 10 of the present invention compared to commercially available pumps for collecting environmental water quality samples from monitoring wells.

Cost of Operation: Since the mechanical bladder pump of the present invention does not require a pump controller, air compressor, power supply to run the compressor, special connections, and pressure hoses to connect and operate the pump system, there is a substantial savings in operational cost.

Power Supply: The mechanical bladder pump of the present invention can be operated manually, with mechanical assistance, or by a small, relatively inexpensive electric motor. The power required to run an electric motor-operated version could be supplied from a standard motor vehicle battery, for example.

Portability: Since the mechanical bladder pump of the present invention does not require a pump controller, air compressor or generator to operate in the field, the system is very portable and mobile for field use to conduct well sampling.

Pump Cost: The cost of the pump 10 will be comparable to or less than available gas driven bladder pumps.

Sample Quality: The mechanical bladder pump of the present invention does not significantly agitate or heat the sample, does not apply excessive vacuum to the sample, and minimizes the velocity of flow and changes in flow velocity through the pump. Accordingly, the sample quality should exceed that of gear pumps, impeller pumps, peristaltic pumps, and vacuum pumps for environmental water quality sampling purposes. The sample quality should be similar, if not equivalent to, that obtained from gas driven bladder pumps when operated appropriately following the low flow rate, minimal draw down sampling procedures.

Flow Rate: The flow rates achievable with the mechanical bladder pump of the present invention may be lower than the flow rate of more expensive devices. However, the mechanical bladder pump will meet or exceed the flow rate requirements for environmental sampling using the low-flow, minimal draw down method. The flow rate can be varied from less than 100 ml/min to more than one liter per minute, depending on the size of the pump and the cycle frequency at which the pump is operated. The maximum flow rates will exceed the requirements for all current practices in environmental groundwater sampling activities. Although the preferred embodiment of the present invention has been developed for groundwater sampling activities, larger versions of the disclosed pump could be used in water supply wells or industrial pumping applications.

Pump Performance/Lift Capacity: The mechanical bladder pump of the present invention may not provide the lift capacity of more complex and expensive gear pumps and impeller pumps. However, it will provide lift capacity similar to or exceeding that of similar sized, commercially available gas driven bladder pumps.

Pump Performance/Durability: Because of its simple design and limited number of moving parts, the pump of the present invention will be durable and capable of long term installation and operation in monitoring wells.

Ease of Maintenance: Because of the limited number of parts and ease of assembly and disassembly, maintenance of the device in the field will be relatively quick and easy.

While the invention has been specifically described in connection with specific embodiments thereof, it is to be understood that this is by way of illustration and not of limitation, and the scope of the appended claims should be construed as broadly as the prior art will permit.

What is claimed is:

1. A mechanical bladder pump for collecting fluid samples from a well, comprising:

an outer tubular member having a longitudinal bore;

an inner member arranged within the bore of the outer tubular member for oscillating longitudinal movement of the inner member relative to the outer member;

a bladder having a first end fixed relative to a lower end of the inner member and a second end fixed relative to a lower end of the outer member, the bladder being in fluid communication with an inlet passage and an outlet passage;

a first check valve arranged in said inlet passage for allowing fluid to enter the bladder through the inlet passage upon expansion of the bladder and preventing fluid from exiting the bladder through the inlet passage upon compression of the bladder;

a second check valve arranged in said outlet passage for preventing fluid from entering the bladder through the outlet passage upon expansion of the bladder and allowing fluid to exit the bladder through the outlet passage upon compression of the bladder; and a return spring that stores energy during a tension stroke of the inner member in an upward direction relative to the outer member and releases energy during a compression stroke of the inner member in a downward direction relative to the outer member.

2. The mechanical bladder pump according to claim 1, wherein said inner member is tubular and provides a means for transmitting force for mechanically powering the bladder of the pump from a point of operation above the well.

3. The mechanical bladder pump according to claim 1, wherein said outer tubular member provides a means for holding the pump in a desired position within a well.

4. The mechanical bladder pump according to claim 1, wherein said inner member is tubular and is concentric with said outer tubular member.

5. The mechanical bladder pump according to claim 1, wherein said bladder has corrugations along its length and is arranged within the outer tubular member for expansion and contraction in a longitudinal direction.

6. The mechanical bladder pump according to claim 1, wherein each of said check valves comprises a check ball, a valve seat facing a lower side of the check ball, and a projection facing an upper side of the check ball.

7. The mechanical bladder pump according to claim 1, wherein said second end of the bladder is a lower end of the bladder and is fixed relative to the lower end of the outer tubular member by a lower bladder adapter, said lower bladder adapter having a projection on its lower end that prevents a check ball of the first check valve from seating to close against the lower bladder adapter.

8. The mechanical bladder pump according to claim 1, wherein said first end of the bladder is an upper end of the bladder and is fixed relative to the lower end of the inner tubular member by an upper bladder adapter and a check ball retainer of said second check valve, wherein said check ball retainer is attached to said upper bladder adapter, and wherein said check ball retainer has a projection on a lower surface thereof which prevents a check ball from closing said second passage upon compression of the bladder.

9. The mechanical bladder pump according to claim 1, wherein said first end of the bladder is art upper end of the bladder and is fixed relative to the lower end of the inner tubular member by an upper bladder adapter which functions as a movable piston to compress and expand the bladder during operation of the pump.

10. The mechanical bladder pump according to claim 1, wherein at least a portion of said inner member is flexible.

11. The mechanical bladder pump according to claim 1, wherein at least a portion of said inner member is made of a polymeric material.

12. A mechanical bladder pump for collecting fluid samples from a well, comprising:

an outer tubular member having a longitudinal bore;

an inner tubular member arranged within the bore of the outer tubular member for oscillating longitudinal movement of the inner member relative to the outer member;

a bladder having a first end fixed relative to a lower end of the inner member and a second end fixed relative to a lower end of the outer member, one of the first and second ends of the bladder being in fluid communication with an inlet passage, and the other of said first and second ends of said bladder being in fluid communication with an outlet passage;

a first check valve arranged in said inlet passage for allowing fluid to enter the bladder through the inlet passage upon expansion of the bladder and preventing fluid from exiting the bladder through the inlet passage upon compression of the bladder;

a second check valve arranged in said outlet passage for preventing fluid from entering the bladder through the outlet passage upon expansion of the bladder and allowing fluid to exit the bladder through the outlet passage upon compression of the bladder; and a return spring that stores energy during a tension stroke of the inner tubular member and releases energy during a compression stroke of the inner tubular member, said spring being arranged to bias the inner tubular member in a downward direction relative to the outer tubular member.

13. The mechanical bladder pump according to claim 12, further comprising a spring retainer secured within the bore of the outer tubular member, said spring retainer having a circular lip on a lower end thereof for retaining the spring in a concentric position relative to the inner tubular member.

14. The mechanical bladder pump according to claim 12, further comprising a spring retainer secured within the bore of the outer tubular member, said spring retainer providing a vertical stop against which an upper end of the spring rests during operation of the pump.

15. The mechanical bladder pump according to claim 12, wherein said first end of the bladder is an upper end of the bladder and is fixed relative to the lower end of the inner tubular member by an upper bladder adapter and a check ball retainer of said second check valve, and wherein a surface on an upper end of the check ball retainer provides a seat for a lower end of the spring.

16. A method of collecting a fluid sample from a well, comprising the steps of:

providing a pumping device having an inner member and an outer member which are arranged together for oscillating movement relative to each other in a longitudinal direction, and a pump mechanism comprising a bladder having a first end fixed relative to the inner member and a second end fixed relative to the outer member;

placing the pumping device in a well; and oscillating the inner member relative to the outer member to mechanically power the pump mechanism to pump a fluid sample to an outlet of the pumping device;

wherein said oscillating step comprises a tension stroke in which said inner member is pulled upward relative to said outer member to expand the bladder, and a compression stroke in which said inner member is moved downward relative to said outer member to contract the bladder, and wherein said pumping device comprises a return spring that stores energy during said tension stroke and releases energy during said compression stroke.

* * * * *